United States Patent [19]

Rust et al.

[11] 4,125,173

[45] Nov. 14, 1978

[54] SCAFFOLD DEVICE

[76] Inventors: Willard J. Rust; Willard M. Rust, both of R.R. 2, Spencer, Nebr. 68777

[21] Appl. No.: 639,921

[22] Filed: Dec. 11, 1975

[51] Int. Cl.[2] ..... E04G 1/20; E04G 1/24

[52] U.S. Cl. ..... 182/63; 182/127; 182/145

[58] Field of Search ..... 182/145, 146, 63, 142, 182/127, 103, 102; 280/142; 135/15; 248/354

[56] References Cited

U.S. PATENT DOCUMENTS

| | | | |
|---|---|---|---|
| 516,078 | 3/1894 | Comstock | 135/15 PQ |
| 1,442,694 | 1/1923 | Martin | 182/172 |
| 2,106,923 | 2/1938 | Tuft | 280/142 |
| 3,576,233 | 4/1971 | Thatcher | 182/145 |
| 3,851,728 | 12/1974 | Williams | 182/146 |

*Primary Examiner*—Reinaldo P. Machado
*Attorney, Agent, or Firm*—Zarley, McKee, Thomte, Voorhees & Sease

[57] ABSTRACT

A scaffold device comprising a wheeled frame means including a front axle assembly and a rear axle assembly which are pivotally interconnected about a horizontal axis whereby either of the axle assemblies may be pivoted or rotated relative to the other. A first post is pivotally connected at its lower end to the front axle assembly and extends upwardly therefrom. A telescoping support is pivotally connected at its lower end to the front axle assembly and extends upwardly to a pivotal connection with the first post to permit the first post to be vertically positioned regardless of the attitude of the front axle assembly. A second post is pivotally secured at its lower end to the rear axle assembly and extends upwardly therefrom. A telescoping support is pivotally connected at its lower end to the rear axle assembly and is pivotally connected at its upper end to the second post adjacent the upper end thereof to permit the second post to be vertically positioned regardless of the attitude of the rear axle assembly. A platform is slidably mounted on the first and second posts and extends therebetween. The ends of the platform are raised and lowered by means of a winch mounted on each of the first and second posts. Braces interconnect the posts to prevent their separation.

9 Claims, 7 Drawing Figures

SCAFFOLD DEVICE

BACKGROUND OF THE INVENTION

This invention relates to a scaffold device and more particularly to a scaffold device mounted on a wheeled frame means.

Conventional scaffolding ordinarily comprises a plurality of vertical posts which are interconnected by crossbraces and which may be stacked on top of each other to permit workmen to work walls or the like. The erection of the conventional scaffolds is time consuming and is difficult when the terrain adjacent the wall or the like is irregular. The limited width of the scaffolds requires that additional scaffolding be placed adjacent thereto or that the scaffolding be moved laterally as each portion of the wall is completed.

Therefore, it is a principle object of the invention to provide an improved scaffold device.

A further object of the invention is to provide a scaffold device which is mounted on a running gear.

A furhter object of the invention is to provide a scaffold device which is mounted on a wheeled frame means including means for adjusting the attitude of the scaffold.

A further object of the invention is to provide a scaffold device which is easily moved from location to location.

A further object of the invention is to provide a scaffold device which is easily assembled and disassembled.

A further object of the invention is to provide a scaffold device having the ability to be adjusted for irregular terrain.

A further object of the invention is to provide a scaffold device including a vertically movable platform wherein workmen may work beneath the platform if desired.

A still further object of the invention is to provide a scaffold device which is economical to manufacture, durable in use and refined in appearance.

DESCRIPTION OF THE PREFERRED EMBODIMENT

Figure 1:
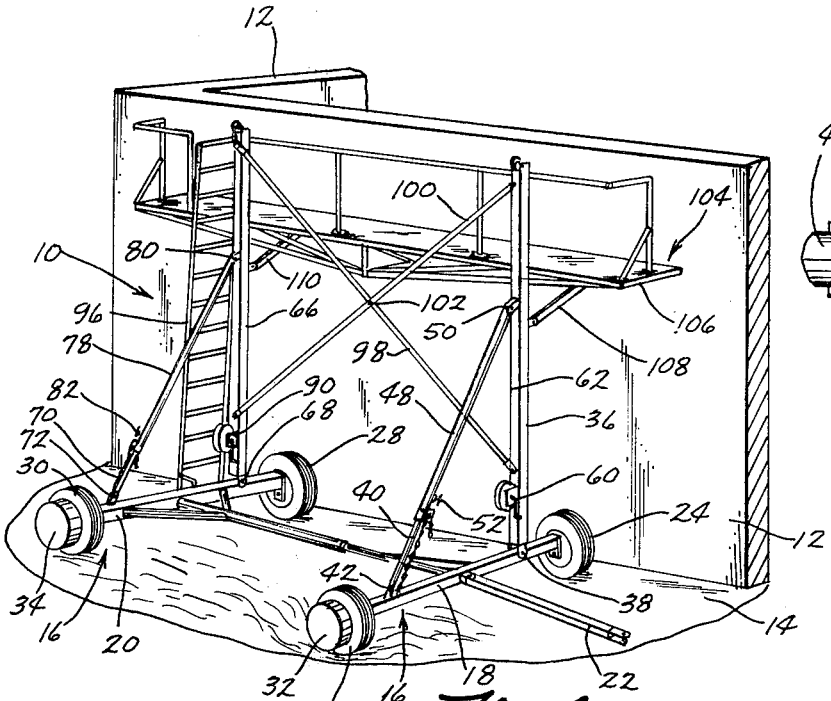
FIG. 1 is a perspective view of the scaffold of this invention positioned adjacent a wall.
Figure 7:
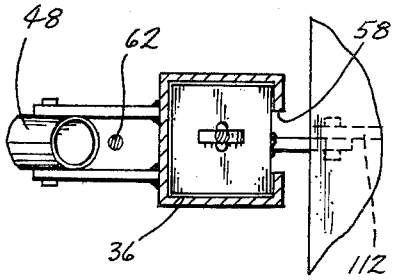
FIG. 7 is a sectional view seen on lines 7—7 of FIG. 6.
Figure 2:
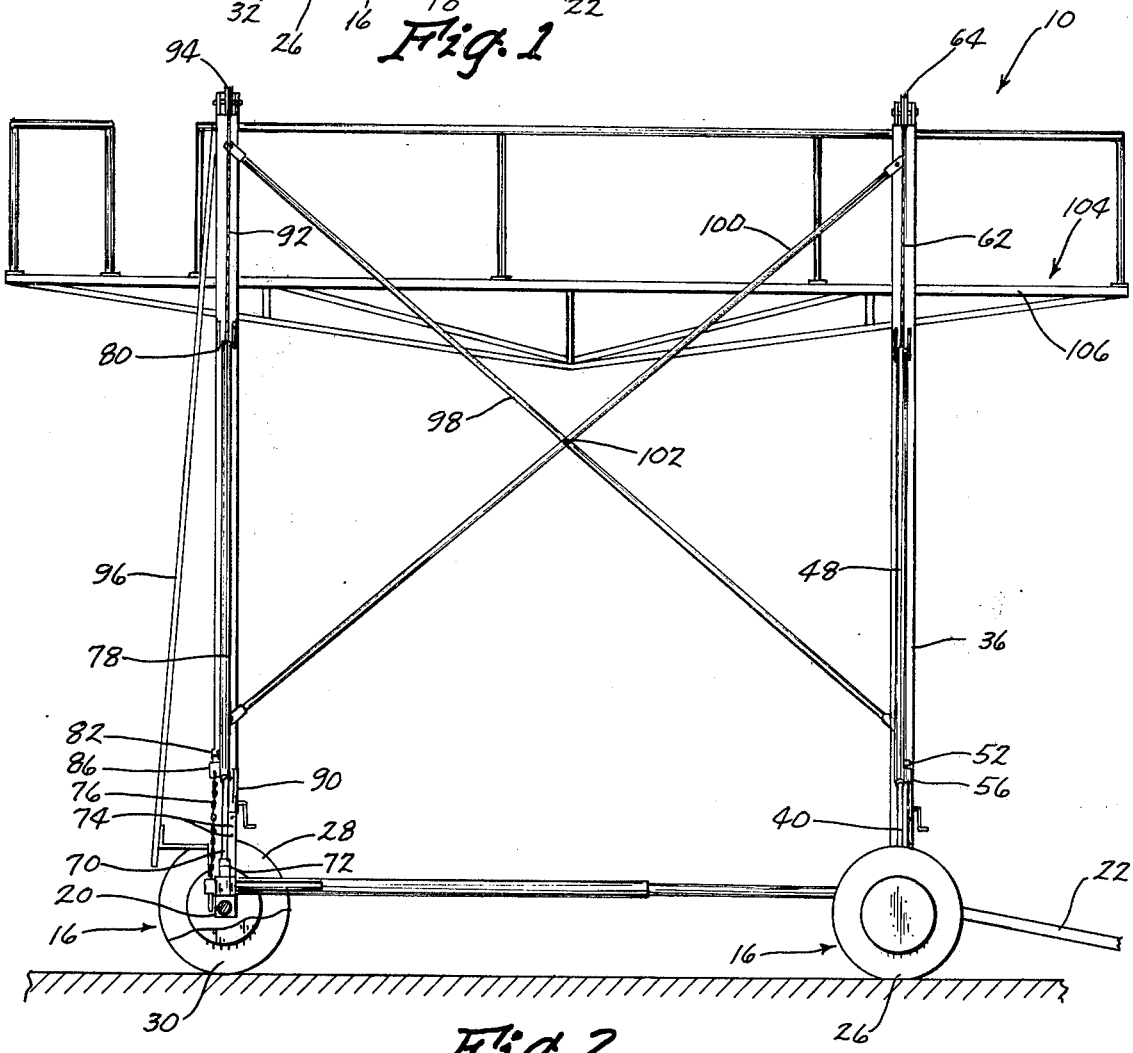
FIG. 2 is a side view of the scaffold.
Figures 3, 4, 5, 6:
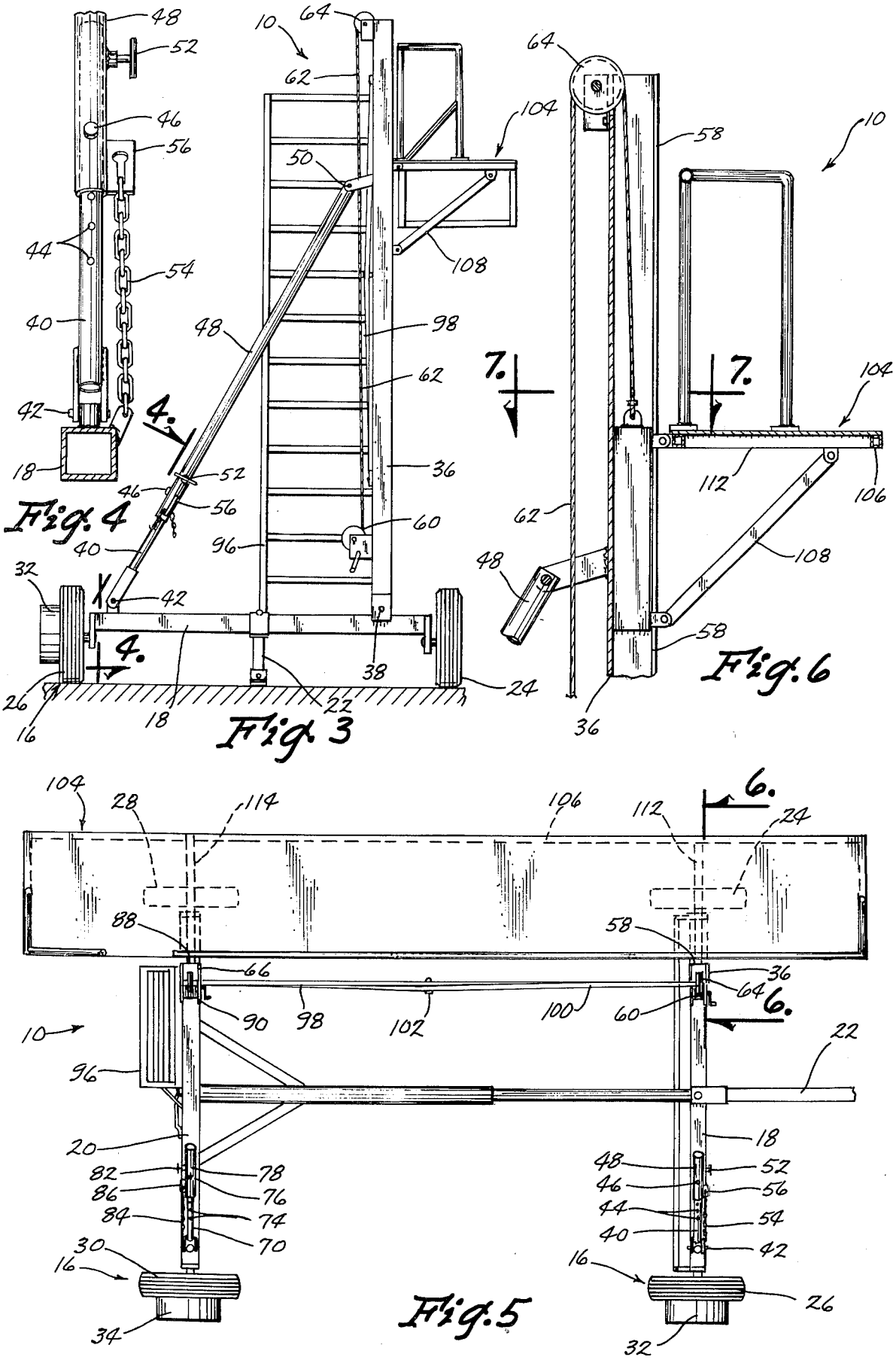
FIG. 3 is an end view of the scaffold.
FIG. 4 is a sectional view seen on lines 4—4 of FIG. 3.
FIG. 5 is a top view.
FIG. 6 is an enlarged sectional view seen on lines 6—6 of FIG. 5.

The scaffold of this invention is referred to generally by the reference numeral 10 while the numeral 12 refers to a wall structure of the like extending upwardly from the ground surface 14. Scaffold 10 includes a wheeled frame means or running gear 16 of generally conventional design and similar to farm wagon running gears. Frame means 16 includes a front axle assembly 18 and a rear axle assembly 20 which are pivotally or rotatably connected about a horizontal axis in conventional fashion so that either of the axle assemblies may be rotated relative to the other. Hitch 22 extends forwardly from front axle assembly 18 for pulling the frame means from location to location. Front axle assembly 18 includes a pair of wheels 24 and 26 while rear axle assembly includes wheels 28 and 30. Preferably, wheel weights 32 and 34 are mounted on wheels 26 and 30.

Post 36 is pivotally connected at its lower end to front axle assembly 18 at 38 and extends upwardly therefrom adjacent wheel 24. Tube 40 is pivotally connected to front axle assembly 18 at 42 adjacent wheel 26 and extends upwardly and inwardly therefrom. Tube 40 is provided with a plurality of spaced-apart openings 44 adapted to receive a pin 46 therein. Tube 48 slidably or telescopically embraces the upper end of tube 40 and is pivotally connected at its upper end to post 36 at 50. A set screw 52 threadably extends inwardly into tube 48 as seen in the drawings and is adapted to engage tube 40 to prevent telescopic movement therebetween. Pin 46 extends through one of the openings 44 immediately below the lower end of tube 48 to prevent downward movement of tube 48 relative to tube 50. Safety chain is connected at one end to front axle assembly 18 and is adjustably connected to the bracket 56 extending outwardly from the lower end of tube 48 to prevent tube 48 from moving upwardly relative to tube 40.

Post 36 is provided with a slot 58 formed in the inner side thereof for a purpose to be described in more detail hereinafter. Winch 60 is secured to post 36 adjacent the lower end thereof and has a cable 62 extending upwardly therefrom over a pully 64 rotatably mounted on the upper end of post 36.

Post 66 is pivotally connected at its lower end to rear axle assembly 20 at 68 and extends upwardly therefrom adjacent wheel 28. Tube 70 is pivotally connected at its lower end to rear axle assembly 20 at 72 adjacent wheel 30 and extends upwardly and inwardly therefrom. Tube 70 is provided with a plurality of spaced-apart openings 74 formed therein adapted to receive a pin 76. Tube 78 slidably or telescopically embraces the upper end of tube 70 and is pivotally connected at its upper end to post 66 at 80. Set screw 82 threadably extends through tube 78 and is adapted to engage tube 70 to prevent the telescopic or slidable movement between tubes 70 and 78. Safety chain 84 is connected at one end to rear axle assembly 20 and is adjustably connected to bracket 86 extending outwardly from the lower end of tube 78 to prevent upward movement of tube 78 relative to tube 70. Pin 76 is extended through the opening 74 immediately below tube 78 to prevent downward movement of the tube 78 relative to tube 70.

Post 66 is provided with a vertically extending slot 88 formed in its inner side thereof for a purpose to be described in more detail hereinafter. Winch 90 is secured to post 66 adjacent the lower end thereof and has a cable 92 extending upwardly therefrom which extends over pully 94 rotatably mounted on the upper end of post 66. Ladder 96 is suitably connected to rear axle assembly 20 and post 66.

Brace 98 is connected at its upper end to post 66 adjacent the upper end thereof and is connected at its lower end to post 36 adjacent the lower end thereof. Brace 100 is connected at its upper end to post 36 adjacent the upper end thereof and is connected at its lower end to post 66 adjacent the lower end thereof. Bolt 102 extends through braces 98 and 100 at the intersection thereof.

The numeral 104 refers generally to a platform which is selectively, vertically, movably mounted on the posts 36 and 66 through the use of the winches 60 and 90.

Platform 104 generally comprises a frame means 106 including a pair of spaced-apart supports 108 and 110 which have one end thereof slidably mounted in the slots 58 and 88 in posts 36 and 66 respectively. Brace 112 is connected at its upper end to support 108 and has its lower end slidably mounted in slot 58. Brace 114 is connected at its upper end to support 110 and has its lower end slidably mounted in the slot 88. Cables 62 and 92 are connected to the platform 104 to permit the ends of the platform to be raised or lowered relative to the posts 36 and 66 respectively.

The scaffold device of this invention may be easily disassembled and placed on the wheeled frame means 16 when the scaffold is to be transported for long distances. When the desired location has been reached, the scaffold device is assembled as previously described. The wheeled frame means 16 is driven or pulled adjacent the wall 12 and the pivotal connection between the front and rear axle assemblies does not require that the wheels be perfectly level. In fact, either of the axle assemblies could be pivoted as much as 30° relative to the other without causing any serious problems.

When the wheeled frame means 16 is in position, post 36 is easily vertically positioned through the use of the telescopic tubes 40 and 48. Set screw 52 is simply loosened and post 36 is pivotally moved until it is vertically positioned. Set screw 52 is then tightened and a pin or bolt 46 is extended through the opening 44 in tube 40 immediately below tube 48 to prevent tube 48 from moving downwardly on tube 40. Safety chain 54 is then connected to the bracket 56 which prevents tube 48 from moving upwardly relative to tube 40. Post 66 is also vertically positioned in the same manner as was post 36.

The winches 60 and 90 are operated to cause the platform 104 to be raised and lowered relative to the posts 36 and 66 to enable the workmen to work on the wall structure at any desired height. Since the platform 104 extends outwardly from the posts 36 and 66, the area beneath the platform is free and clear of obstructions so that workmen may work on the wall structure below the platform. The fact that each end of the platform is individually adjustably controlled by the winch on the respective post permits the platform to be precisely adjusted regardless of whether the supporting axle assembly is higher or lower than the other axle assembly. The device is easily moved along the length of the wall structure by simply pulling the same relative thereto.

Thus it can be seen that a novel scaffold device has been provided which is not only safe to use but which is convenient and which does not require the time consuming erection of individual scaffolds as in conventional scaffolding devices. Thus it can be seen that the scaffold device accomplishes at least all of the stated objectives.

I claim:

1. A scaffold device, comprising, a wheeled frame means comprising a front axle assembly and a rear axle assembly, said front and rear axle assemblies being pivotally connected together about a horizontal axis whereby one of said axle assemblies may be pivoted relative to the other, a first support having upper and lower ends, said first support being selectively pivotally secured at its lower end to said front axle assembly and extending upwardly therefrom, a second support having upper and lower ends, said second support being selectively pivotally secured at its lower end to said rear axle assembly and extending upwardly therefrom, a platform vertically movably mounted on said first and second supports and extending therebetween, and means for raising and lowering said platform relative to said first and second supports.

2. The device of claim 1 wherein said means for raising and lowering said platform comprises a winch means.

3. The device of claim 2 wherein a winch means is secured to each of said first and second supports, each of said winch means being operatively connected to one end of said platform.

4. The device of claim 1 wherein a first length adjustable member is pivotally secured at one end to said front axle assembly and is pivotally secured at its other end to said first support, and a second length adjustable member pivotally secured at one end to said rear axle assembly and is pivotally secured at its other end to said second support.

5. The device of claim 4 wherein each of said length adjustable members comprises an inner tube member having an outer tube member slidably received thereon, and locking means for locking said inner and outer tube members together to prevent relative movement therebetween.

6. The device of claim 5 wherein said locking means comprises a set screw means threadably extending through said outer tube member and into engagement with said inner tube member.

7. The device of claim 5 wherein a safety chain extends between said outer tube member and the associated axle assembly.

8. The device of claim 5 wherein said inner tube member has a plurality of spaced-apart openings formed therein for receiving a pin means positioned below said outer tube member.

9. The device of claim 1 wherein each of said axle assemblies have inner and outer wheel members with respect to the building structure adjacent thereto, said first and second supports being positioned adjacent said inner wheel members, said platform extending from said first and second supports whereby a work area is provided between the building structure and the inner wheel members below said platform.

* * * * *